US010242507B2

(12) United States Patent
Shardlow et al.

(10) Patent No.: US 10,242,507 B2
(45) Date of Patent: Mar. 26, 2019

(54) TICKET DISPENSER

(71) Applicant: Fastrak Retail (UK) Limited, Macclesfield (GB)

(72) Inventors: Paul Shardlow, Macclesfield (GB); Stephen Matthews, Stockport (GB)

(73) Assignee: Fastrak Retail (UK) Limited, Cheshire (GB)

( * ) Notice: Subject to any disclaimer, the term of this patent is extended or adjusted under 35 U.S.C. 154(b) by 0 days.

(21) Appl. No.: 15/522,693

(22) PCT Filed: Nov. 2, 2015

(86) PCT No.: PCT/GB2015/053298

§ 371 (c)(1),
(2) Date: Apr. 27, 2017

(87) PCT Pub. No.: WO2016/067057

PCT Pub. Date: May 6, 2016

(65) Prior Publication Data

US 2017/0316620 A1 Nov. 2, 2017

(30) Foreign Application Priority Data

Oct. 31, 2014 (GB) ..... 1419490.6

(51) Int. Cl.

| | |
|---|---|
| ***B65D 83/12*** | (2006.01) |
| ***G07B 3/04*** | (2006.01) |
| ***G07B 7/00*** | (2006.01) |
| ***B65D 83/08*** | (2006.01) |
| ***G07B 1/00*** | (2006.01) |

(52) U.S. Cl.

CPC ..... *G07B 3/04* (2013.01); *B65D 83/0864* (2013.01); *B65D 83/12* (2013.01); *G07B 1/00* (2013.01); *G07B 7/00* (2013.01)

(58) Field of Classification Search

USPC ..... 221/33–63; 206/39.7, 39; 225/32, 43, 53
See application file for complete search history.

(56) References Cited

U.S. PATENT DOCUMENTS

| | | | |
|---|---|---|---|
| 1,122,673 | A | 12/1914 | Winter |
| 1,400,619 | A | 12/1921 | Marcuse |

(Continued)

FOREIGN PATENT DOCUMENTS

| | | | |
|---|---|---|---|
| GB | 2025366 | A | 1/1980 |
| WO | 2005050577 | A1 | 6/2005 |

OTHER PUBLICATIONS

International Search Report and Written Opinion for corresponding PCT Application No. PCT/GB2015/053298, dated Feb. 18, 2016 (12 pgs.).

(Continued)

*Primary Examiner* — Gene O Crawford
*Assistant Examiner* — Ayodeji T Ojofeitimi
(74) *Attorney, Agent, or Firm* — Shumaker & Sieffert, P.A.

(57) ABSTRACT

A ticket dispenser for dispensing a pleated ribbon of tickets, the ticket dispenser comprising a ticket storage chamber within a housing and a ticket dispensing aperture, wherein the housing has opposed ticket display and rear walls, and also has opposed first and second walls that each extend between the ticket display wall and the rear wall, the display wall comprising: an outer wall having an interior face, and an inner ticket pathway guide proximate the outer wall, providing a ticket display pathway extending along the interior face of the outer wall, between the outer wall and the inner ticket pathway guide, the ticket display pathway having a pathway inlet, wherein the ticket dispenser is configured for a ticket to be drawn out from within the storage chamber, through the pathway inlet, along the ticket display pathway towards the first wall, and out through the dispensing aperture, wherein the ticket storage chamber has a chamber length extending along the display wall between the first wall and the second wall, and the ticket display (Continued)

pathway extends along more than half of the chamber length, wherein the ticket storage chamber is provided with a storage chamber guide configured to space tickets apart from the display wall adjacent a central portion along the length of the ticket display pathway, and wherein the storage chamber guide extends to a maximal separation from the ticket display pathway at a location that is closer to the first wall than the separation between the pathway inlet and the first wall.

19 Claims, 10 Drawing Sheets

(56) References Cited

U.S. PATENT DOCUMENTS

| | | | | |
|---|---|---|---|---|
| 2,373,092 | A | 4/1945 | Avery | |
| 2,869,951 | A * | 1/1959 | Wooster | A47K 10/44 221/62 |
| 4,204,618 | A | 5/1980 | Reed et al. | |
| 4,858,806 | A | 8/1989 | Schafer | |
| 5,100,038 | A * | 3/1992 | Schafer | A47K 10/426 225/32 |
| 5,921,433 | A | 7/1999 | Friar et al. | |
| 6,267,262 | B1 * | 7/2001 | Wilner | B65D 83/0805 221/45 |
| 2011/0101020 | A1 * | 5/2011 | Granger | A47K 10/424 221/45 |
| 2013/0098938 | A1 * | 4/2013 | Efthimiadis | A47K 10/421 221/45 |
| 2014/0319164 | A1 * | 10/2014 | Wilson | A47K 10/422 221/45 |

OTHER PUBLICATIONS

Combined Search and Examination Report from counterpart Great Britain Application No. GB1419490.6, dated Apr. 30, 2015, 9 pp.
Combined Search and Examination Report from counterpart Great Britain Application No. GB1419490.6, dated Jan. 6, 2016, 8 pp.

* cited by examiner

TICKET DISPENSER

This application is a national stage application under 35 U.S.C. § 371 of PCT Application No. PCT/GB2015/053298, filed Nov. 2, 2015, which claims the benefit of Great Britain Application No. 1419490.6, filed Oct. 31, 2014. The entire contents of each of PCT Application No. PCT/GB2015/053298 and Great Britain Application No. 1419490.6 are incorporated herein by reference in their respective entireties.

FIELD OF INVENTION

The present invention relates to ticket dispensers for use with a pleated ribbon of tickets.

BACKGROUND

WO2013041858A1 discloses a ticket dispenser suitable for dispensing tickets from a ribbon of tickets arranged in a pleated pack, in which a first ticket is dispensed to a retailer approximately perpendicular to a front dispensing face of the ticket dispenser. An exemplary ticket may be displayed to a customer through a back face of the ticket dispenser, and the ticket dispenser may be mounted on a retail counter, in which the retailer and customer face opposite sides of the ticket dispenser. The last ticket in the pack may be displayed to a customer, subject to it facing the back of the ticket dispenser, and being the correct way up. However, commonly, a ticket is torn from the pack to place behind the back face of the ticket dispenser, for display to customers. Disadvantageously, a ticket that has been separated from the main ribbon of tickets is no longer able to be dispensed through the dispensing aperture, and the retail staff must take care to remove it before loading the ticket dispenser with a ribbon of tickets of a different type.

SUMMARY OF THE DISCLOSURE

According to an aspect of the invention, there is provided a ticket dispenser for dispensing a pleated ribbon of tickets, the ticket dispenser comprising a ticket storage chamber within a housing and a ticket dispensing aperture, wherein the housing has a ticket display wall and an opposed rear wall, and first and second mutually opposed walls that each extend between the ticket display wall and the rear wall, the display wall comprising: an outer wall having an interior face, and an inner ticket pathway guide proximate the outer wall, providing a ticket display pathway extending along the interior face of the outer wall, between the outer wall and the inner ticket pathway guide, the ticket display pathway having a pathway inlet, wherein the ticket dispenser is configured for a ticket to be drawn out from within the storage chamber, through the pathway inlet, along the ticket display pathway towards the first wall, and out through the dispensing aperture, wherein the ticket storage chamber has a chamber length extending along the display wall between the first wall and the second wall, and the ticket display pathway extends along more than half of the chamber length, wherein the ticket storage chamber is provided with a storage chamber guide configured to space tickets apart from the display wall adjacent a central portion along the length of the ticket display pathway, and wherein the storage chamber guide extends to a maximal separation from the ticket display pathway at a location that is closer to the first wall than the separation between the pathway inlet and the first wall.

There may be provided a ticket dispenser for dispensing a ribbon of tickets, the ticket dispenser comprising a housing having a composite ticket dispensing wall and a ticket dispensing aperture, the interior of the housing comprising a ticket storage chamber, the dispensing wall comprising: an outer wall having an interior face, an inner ticket channel guide element, and a ticket channel extending along the interior face of the outer wall and between the outer wall and inner ticket channel guide element, the ticket channel providing a pathway between the storage chamber and the dispensing aperture along the length of the ticket channel and being configured for a ticket to be drawn out through the dispensing aperture from within the storage chamber.

The ticket display pathway may extend along more than three-quarters of the chamber length. Advantageously, by extending along more than half, and optionally more than three-quarters, of the chamber length enables a large proportion of a ticket to be displayed to a user.

The storage chamber guide may be provided in a central region of the ticket storage chamber.

The storage chamber guide may comprise a baffle extending into the ticket storage chamber from proximate the pathway inlet. The baffle may extend generally towards a central region of the ticket storage chamber.

The storage chamber guide may comprise a roller spaced apart from the display wall. The roller may be provided in a central region of the ticket storage chamber.

The storage chamber guide may comprise a fixed curved member spaced apart from the display wall. The fixed curved member may be fully or partially cylindrical or arcuate. If formed from sheet material, the fixed curved member may have an external radius of curvature of at least twice the thickness of the sheet material. The fixed curved member may be a curved end of a baffle. The fixed curved member may be provided in a central region of the ticket storage chamber. Advantageously, being gently curved enhances ticket flow past the fixed curved member.

The storage chamber guide may extend to at least 2 cm from the ticket display pathway. The storage chamber guide may extend to at least 2 cm from the display wall. The storage chamber guide may extend to at least 3 cm from the ticket display pathway. The storage chamber guide may extend to at least 3 cm from the display wall. Advantageously, spacing out tickets in the ticket storage chamber at the storage chamber guide enhances the flow of tickets towards the pathway inlet, and spacing out by at least 2 cm or at least 3 cm from the ticket display pathway or from the display wall may be particularly suitable for use tickets that are 10 to 25 cm long (or arranged in a ticket pack with pleats that are 10 to 25 cm long).

The storage chamber guide may extend to a maximal separation from the ticket display pathway that is in the middle third of the separation between the ticket display pathway and the rear wall. The storage chamber guide may extend to a maximal separation from the display wall that is in the middle third of the separation between the display wall and the rear wall.

The storage chamber guide may extend to a maximal separation from the ticket display pathway at a location that is separated from the first wall by at least one third of the separation between the pathway inlet and the first wall and by less than two thirds of the length of the chamber. The storage chamber guide may extend to a maximal separation from the display wall at a location that is separated from the first wall by at least one third of the separation between the pathway inlet and the first wall and by less than two thirds of the length of the chamber. Advantageously, such location of the maximal separation of the storage chamber guide enables the storage chamber guide to support the ticket pack, if required (e.g. for shorter or less resilient tickets), and to influence the flow of tickets as they are drawn away from the main body of the ticket pack, during dispensing, to reduce the risk of tickets becoming jammed or damanged.

All or part of the outer wall may be formed from transparent material. The outer wall may be provided with a transparent window. A ticket within the ticket display pathway may be visible to a user, through the outer wall, across at least 50% of the width of the ticket display pathway.

The inner ticket pathway guide may comprise an inner wall, and the inner wall and the outer wall at least partially overlap to provide a double-walled region of the dispensing wall, in which the inner wall extends along and is proximate to the outer wall.

Within the double-walled region, the inner wall and the outer wall may each be substantially planar.

The inner ticket pathway guide may comprise lateral guides projecting towards each other from opposite sides of the housing, the lateral guides extending along and proximate to the outer wall.

The inner ticket pathway guide may comprise a roller adjacent the pathway inlet.

The inner ticket pathway guide may comprise a roller adjacent the dispensing aperture.

The outer wall may comprise a manipulation aperture, configured to enable a user to contact the face of a ticket within the ticket display pathway, to enable the user to draw the ticket through the ticket display pathway, and optionally wherein the manipulation aperture is elongate along the length of the ticket display pathway.

The separation between the interior face of the outer wall and the inner ticket display pathway guide may be is greater adjacent the ticket dispensing aperture than adjacent the pathway inlet.

A region of the ticket display pathway adjacent the dispensing aperture may have a separation between the interior face of the outer wall and the inner ticket pathway guide that increases towards the dispensing aperture.

A region of the outer wall adjacent the dispensing aperture extends outwardly away from the storage chamber.

The dispensing aperture may be provided in the display wall proximate to the first wall.

The display wall may be provided with a handle projecting outwardly and proximate to an opposed end of the display wall from the dispensing aperture.

BRIEF DESCRIPTION OF THE DRAWINGS

Embodiments of the invention are further described hereinafter with reference to the accompanying drawings, in which.

DETAILED DESCRIPTION

In the described embodiments, like features have been identified with like numerals, albeit in some cases having one or more of: increments of 100. For example, in different figures, 100, 200, 300 and 400 have been used to illustrate a ticket dispenser for dispensing a pleated ribbon of tickets.

Figure 1A:
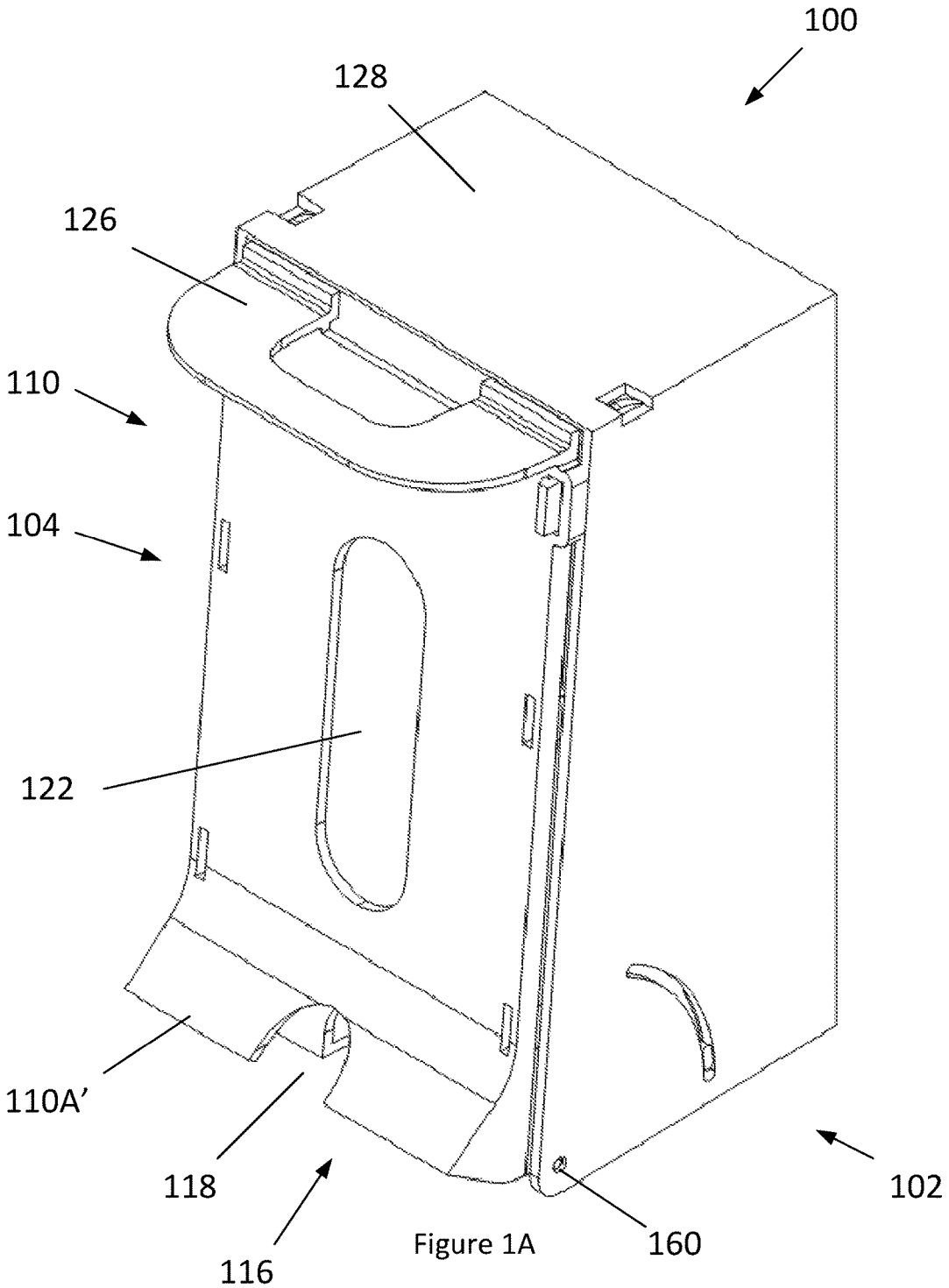
FIGS. 1A to 1C respectively show a ticket dispenser in perspective views with the door closed and open, and viewed directly towards the dispensing wall.
Figure 1B:
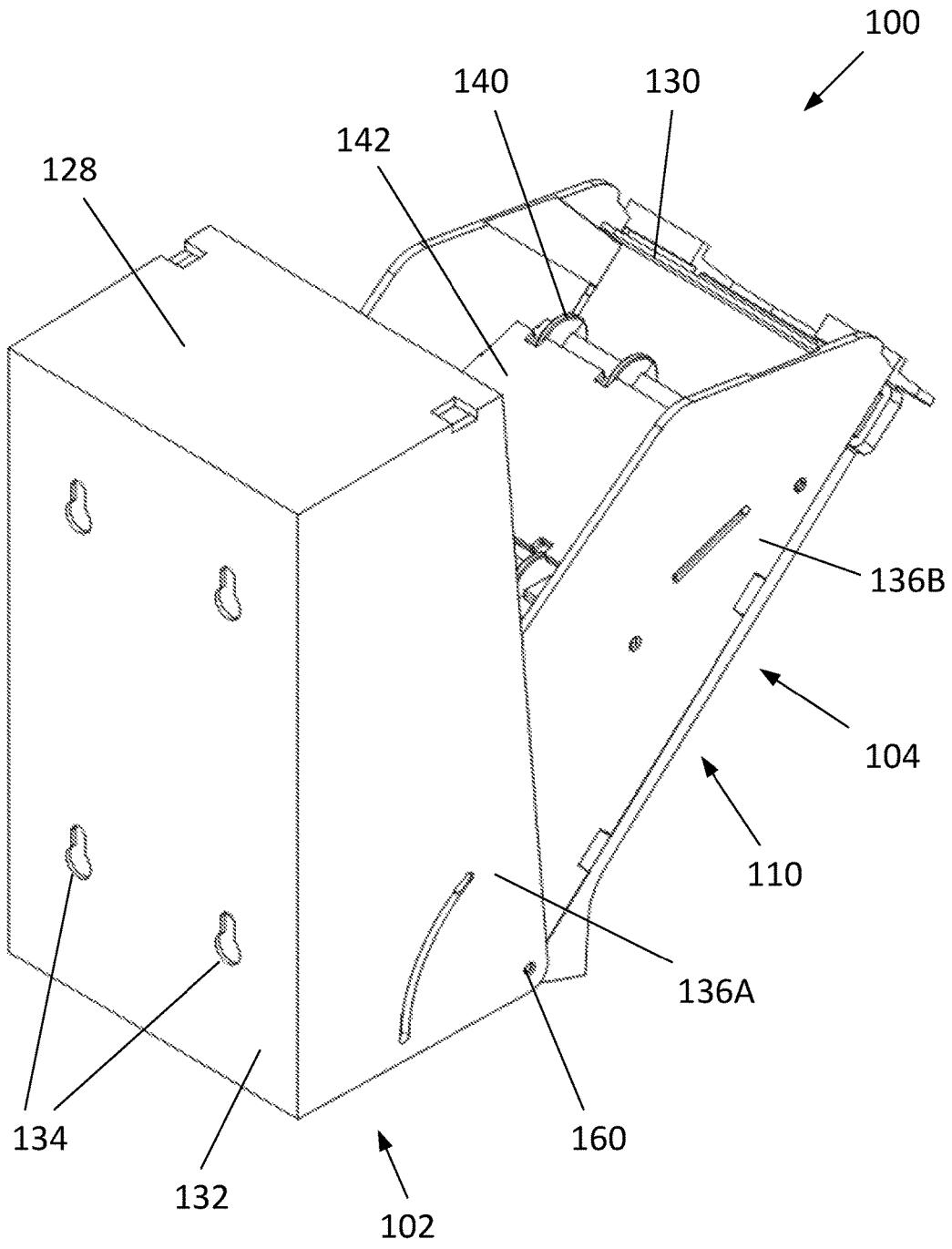
Figure 1C:
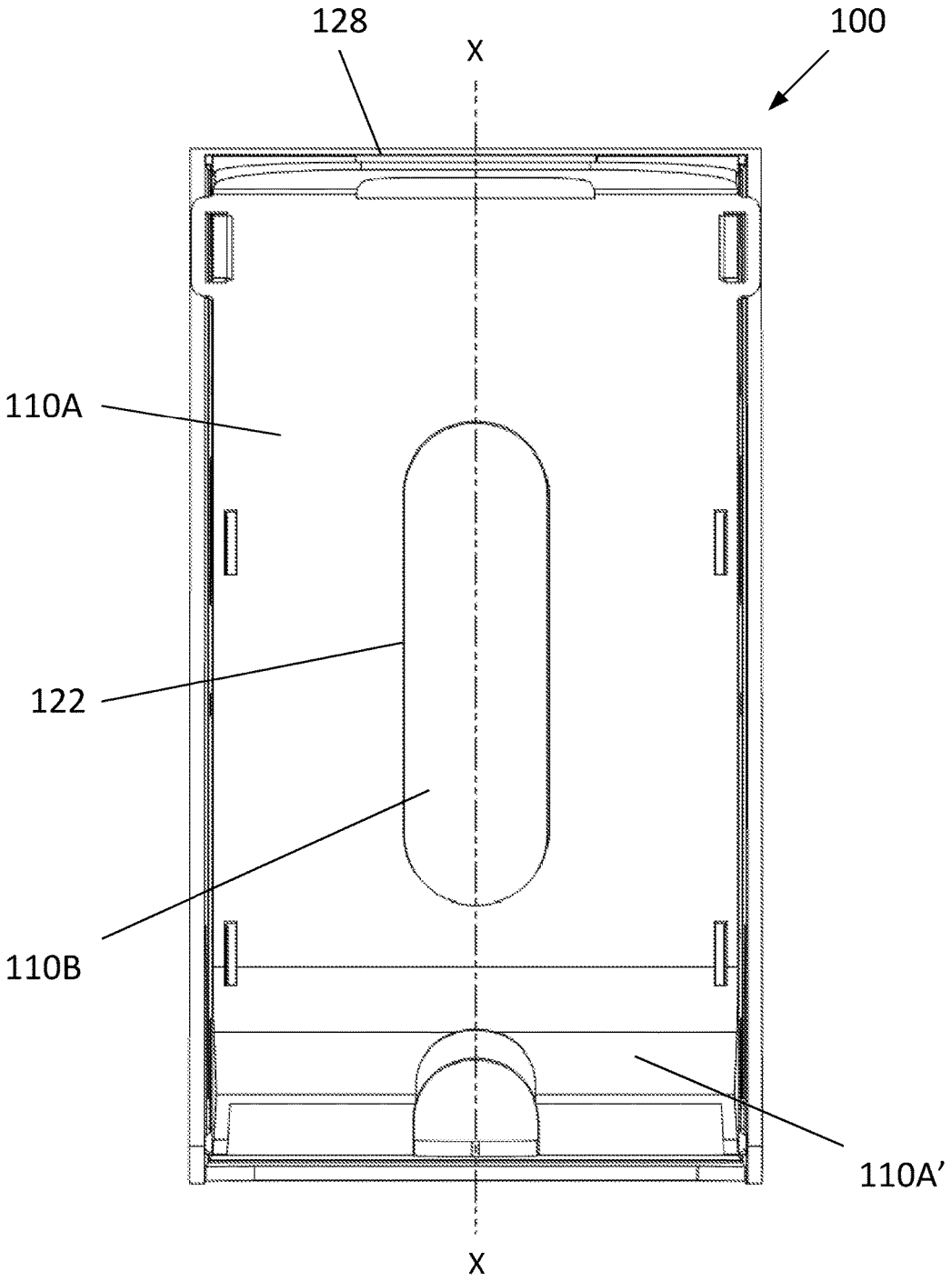
Figure 1D:
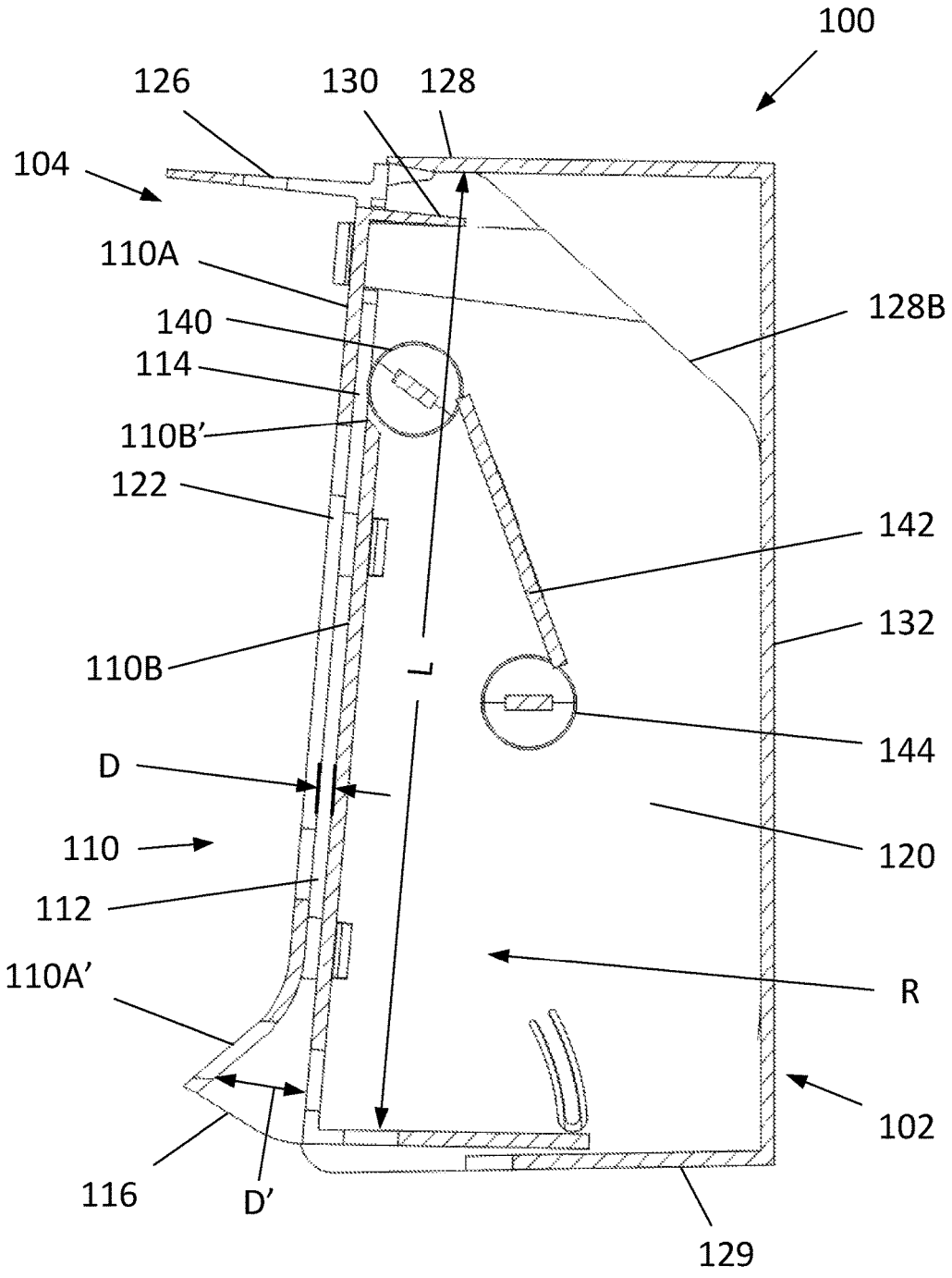
FIG. 1D shows a cut-away view of the ticket dispenser, cut away along the dashed line X-X of FIG. 1C.
Figure 1F:
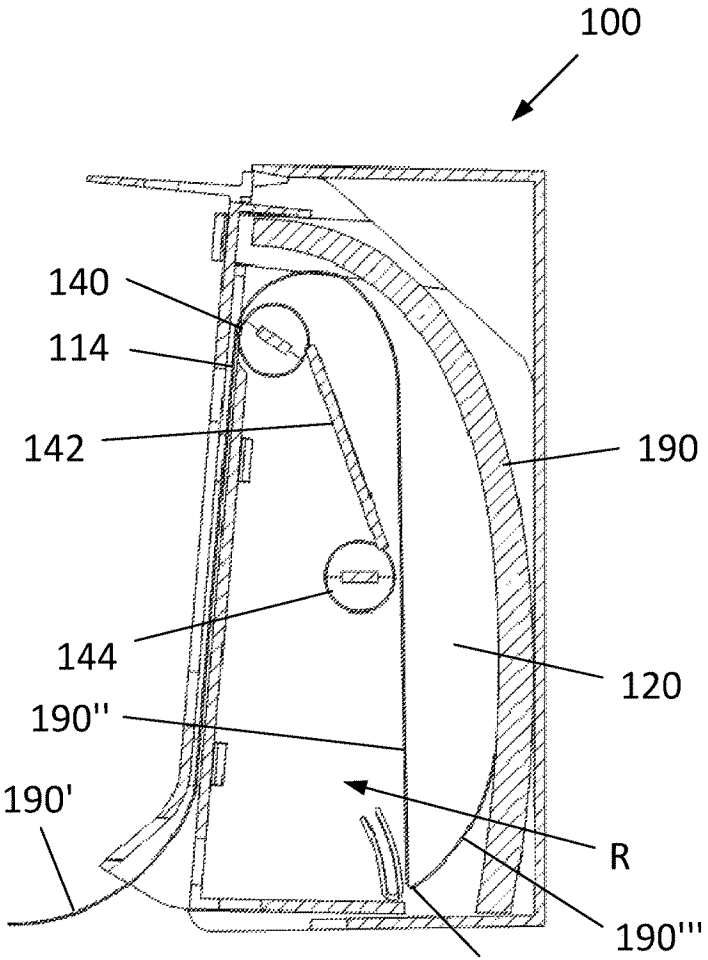
FIGS. 1E to 1J show cut-away views of the ticket dispenser corresponding to FIG. 1D, in which the ticket dispenser is loaded with a ribbon of tickets in a pleated pack, at different stages during the dispensing of a ticket.

FIG. 1A shows perspective views of a ticket dispenser 100 comprising a housing formed by a box-like body 102 with an open end in which a door 104 is pivotably mounted, and FIG. 1B shows a perspective view in which the door is open. FIG. 10 shows a view of the ticket dispenser 100 facing towards the door 104, and FIG. 1D shows a cut-away view of the ticket dispenser corresponding to the section X-X that is indicated in FIG. 1C. FIGS. 1E to 1J illustrate the ticket dispenser 100 with a ticket pack 190 loaded into the ticket storage chamber 120, and the arrangement of the tickets 190', 190" and 190'" during successive stages in the dispensing of a single ticket 190' through the dispensing aperture 116 (the dispensed ticket 190' has not been shown in its entirety).

The door 104 provides the display wall 110 of the ticket dispenser 100. The display wall 110 is formed from an outer wall 110A and an inner wall 110B, and comprises a double-walled region in which the outer and inner walls are in a closely spaced apart configuration, with a ticket pathway 112 (e.g. a ticket channel) between the outer and inner walls. The ticket pathway 112 extends, along its length, from a pathway inlet 114 to a dispensing aperture (i.e. ticket pathway outlet) 116. The pathway inlet 114 of the ticket pathway 112 provides an outlet from the ticket storage chamber 120. Advantageously, the double-walled region promotes controlled dispensing of tickets from within the ticket storage chamber.

Advantageously, if the ticket dispenser 100 is mounted with the display wall 110 facing towards the user (e.g. having the opposite wall of the dispenser mounted onto a wall or other suitable structure), the ticket dispenser enables the ticket that is about to be dispensed (or a substantial portion of it) to be displayed to the user, e.g. a customer.

In the illustrated ticket dispenser 100, the outer and inner walls 110A and 110B are generally substantially planar and parallel in the double-walled region, providing a substantially planar ticket pathway 112. Advantageously, the planar ticket pathway 112 reduces optical distortion in the displaying of the ticket to users, whilst within the ticket pathway.

In use, a pleated ribbon of tickets 190 is loaded into the ticket storage chamber 120, stood on end on the bottom wall 129 (floor) of the ticket storage chamber, and is withdrawn from the storage chamber through the dispensing aperture 116, as required, by being drawn along the ticket pathway 112.

In the illustrated ticket dispenser 100, the ribbon of tickets is received as a pleated pack (also referred to as a "fan fold" or "concertina" pack), and successive tickets on the ribbon 190 are connected by a perforated region extending across the width of the ribbon to facilitate tearing from the remainder of the ribbon. Although the ticket dispenser 100 is described for dispensing tickets, it will be appreciated that the dispenser may also be used to dispense other pleated ribbons of paper or card.

In the illustrated embodiments, at least part of the outer wall 110A, in the double-walled region 116, comprises a transparent material. Advantageously, this enables at least part of a ticket within the ticket pathway 112 to be visible to a user. In the illustrated ticket dispenser 100, the dispensing wall 110 (e.g. door 104) is formed entirely from colourless, transparent material, which enables a large part of a ticket within the ticket pathway 112 to be visible to a user. The outer wall may be provided with a transparent window, or the entire outer wall 110A may be formed from a transparent material. However, alternatively, the outer wall may be opaque, and for example, may be provided with a display panel facing a customer.

In the double-walled region, the outer wall 110A is provided with a manipulation aperture 122, through which a user can contact the surface of a ticket within the ticket pathway 112, e.g. with a finger. Advantageously, the manipulation aperture 122 facilitates loading the ticket ribbon into the ticket pathway 112. Also, the manipulation aperture 122 enables a user to access the ticket within the ticket pathway, if it should become jammed, so that a user can free the ticket ribbon without opening the door 104 (which may additionally be locked, although a lock is not shown in the illustrated ticket dispenser). In particular, to assist in drawing a ticket along the ticket pathway 112, the manipulation aperture 122 is elongate and aligned to extend along the ticket pathway.

In the double-walled region the ticket pathway 112 has a pathway depth D. In the illustrated ticket dispenser 100, the portion 110A' of the outer wall 110A extending to the dispensing aperture 116 projects outwardly (i.e. away from the storage chamber), relative to the portion of the outer wall in the double-walled region, diverging away from the inner wall 110B, providing an end to the ticket pathway 112 that flares outwardly in depth D' (measured perpendicularly to the inner wall 110B) adjacent the dispensing aperture 116. Advantageously, the outwardly projecting portion 110A' of the outer wall 110A facilitates withdrawal of the ticket ribbon towards a user in front of the display wall 110. The outwardly projecting portion 110A' of the outer wall 110A may additionally have a recessed edge portion 118, which advantageously further facilitates the user in grasping the free end of the ticket ribbon 190.

Although in the illustrated ticket dispenser 100, the outer and inner walls 110A and 110B are parallel (away from the flared region of the ticket pathway 112 adjacent the dispensing aperture 116), alternatively, the outer and inner walls may diverge as they extend away from the pathway inlet 114, providing a ticket pathway 112 that increases in depth (separation between the inner and outer walls) along its length. Alternatively, the outer and inner walls 110A and 110B may converge as they extend away from the pathway inlet 114, providing a ticket pathway 112 that decreases in depth (separation between the inner and outer walls) along its length. A divergent or convergent pathway may advantageously enhance ticket flow through the ticket pathway and reduce the risk of a ticket becoming jammed, and/or facilitate freeing any jammed ticket (e.g. by seeking to move the jammed ticket towards a deeper pathway region).

In the illustrated ticket dispenser 100, the pathway inlet 114 and dispensing aperture 116 are proximate opposite ends of the display wall 110, advantageously maximising the length of the double-walled region, in which a ticket may be displayed to a user, in use. In particular, the ticket pathway 112 extends at least half the length L of the ticket storage chamber 120 between the top wall 128 and bottom wall 129 (optionally at least two thirds of the length L, and optionally at least three quarters of the length L), adjacent the display wall 110. Advantageously this may enable at least the majority of a ticket 190' to be displayed to the user whilst within the ticket pathway 112 (e.g. most of a ticket may be displayed from within the ticket pathway, with a small proportion projecting from the dispensing aperture 116).

The door 104 is provided with a releasable clip mechanism (not shown) to retain the door in the closed position. The side wall 136B of the door 104 is provided with a travel limiter, in the form of a projection that engages in an arcuate track in a side wall 136A of the body 102.

The ticket storage chamber 120 has a reduced height adjacent the rear wall 132, in which the top wall 128 is provided with a bevelled portion 128B. Advantageously, reducing the height of the ticket storage chamber 120 adjacent the rear wall 132 inhibits users from loading the ticket pack 190 into the ticket storage chamber with the end of the ticket pack 190 that rests on the bottom wall 129 being against the display wall, and instead promotes loading of the ticket pack 190 into the ticket storage chamber with the bottom of the pack spaced apart from the display wall 110, leaving the corresponding region R of the ticket storage chamber free, to allow tickets 190" and 190'" to curl into the region R as the free end of the ticket ribbon is drawn out of the dispensing aperture 116.

A handle 126 is provided projecting outwardly from the display wall 110, close to the opposite end of the display wall from the dispensing aperture 116 (proximate the upper wall 128). Advantageously, if a further upper ticket dispenser is mounted above the present lower ticket dispenser 100, the handle 126 reduces the extent to which the end of a ticket ribbon hanging out from the upper ticket dispenser (i.e. next to the top wall 128 of the lower dispenser) obscures the ticket that is on display in the lower ticket dispenser.

Figure 1E:
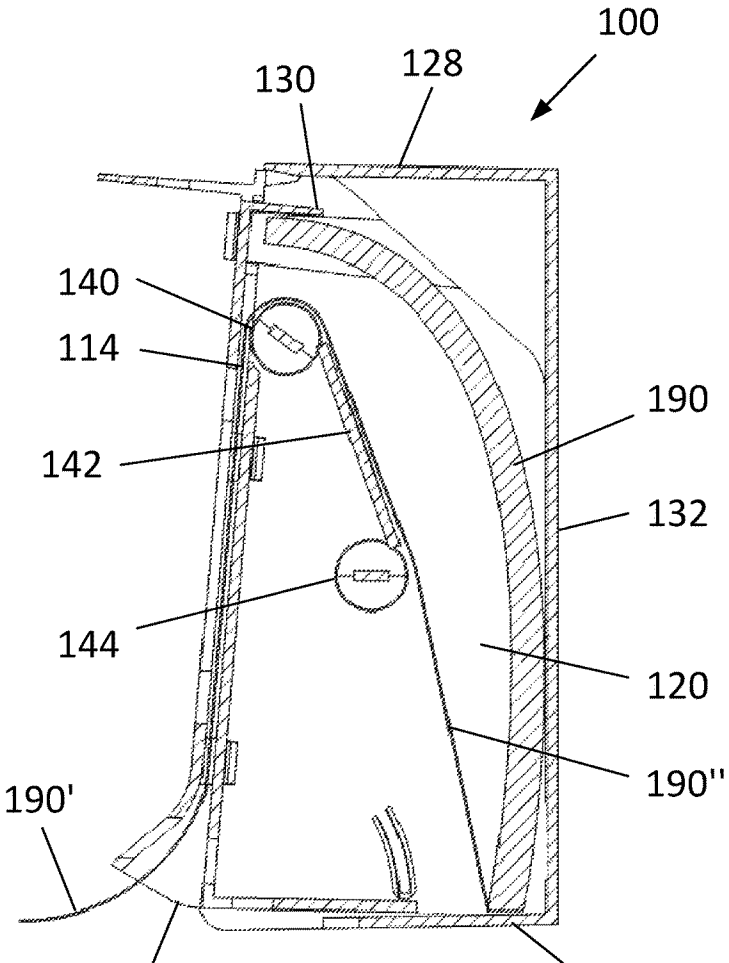
Figure 1H:
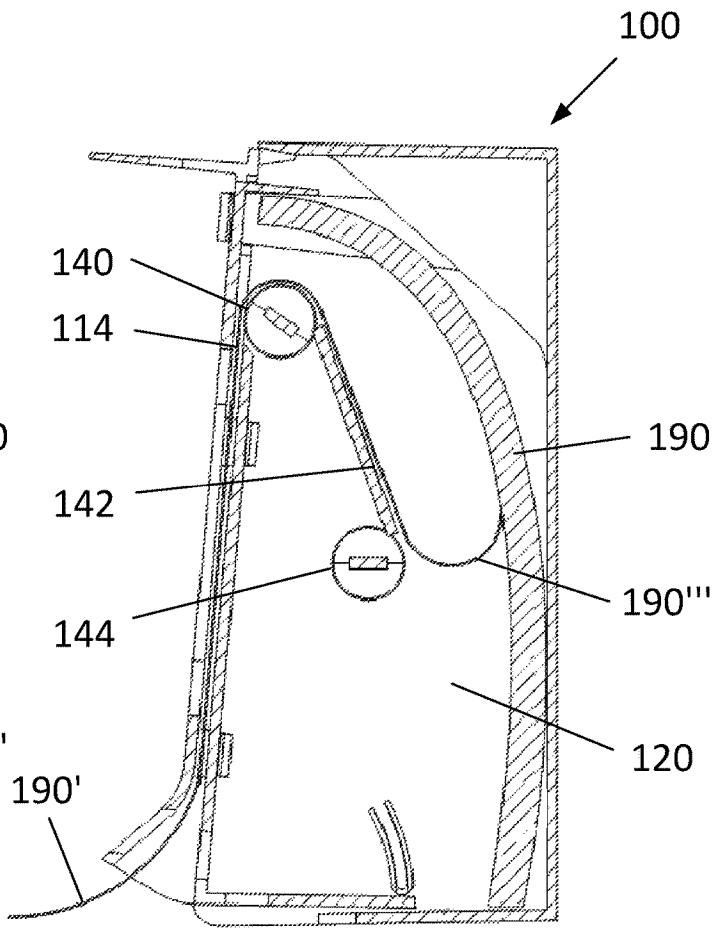
Figure 1G:
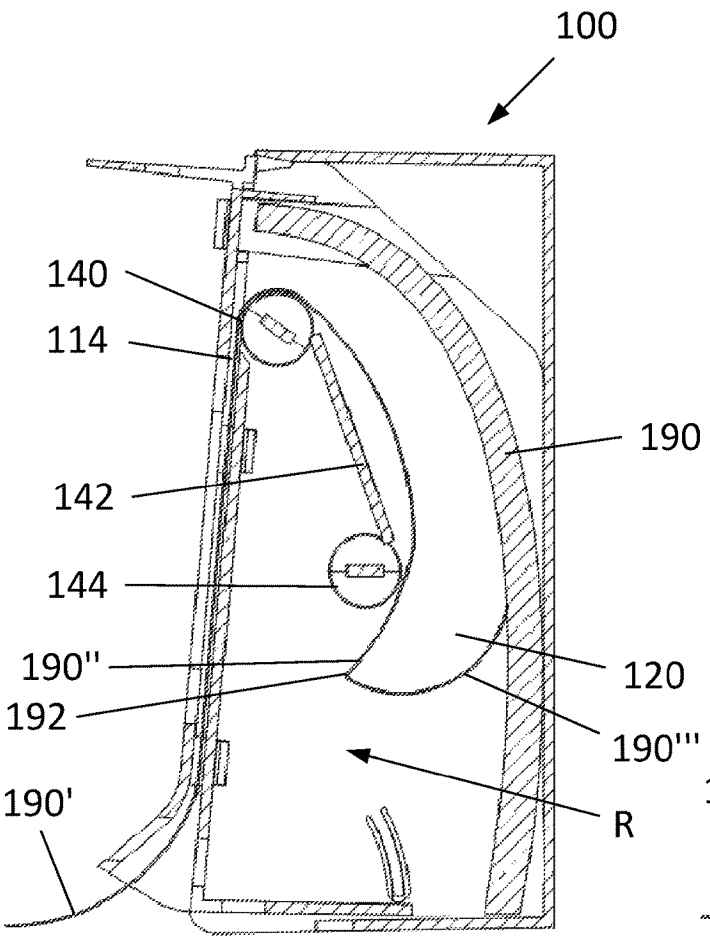
Figure 1J:
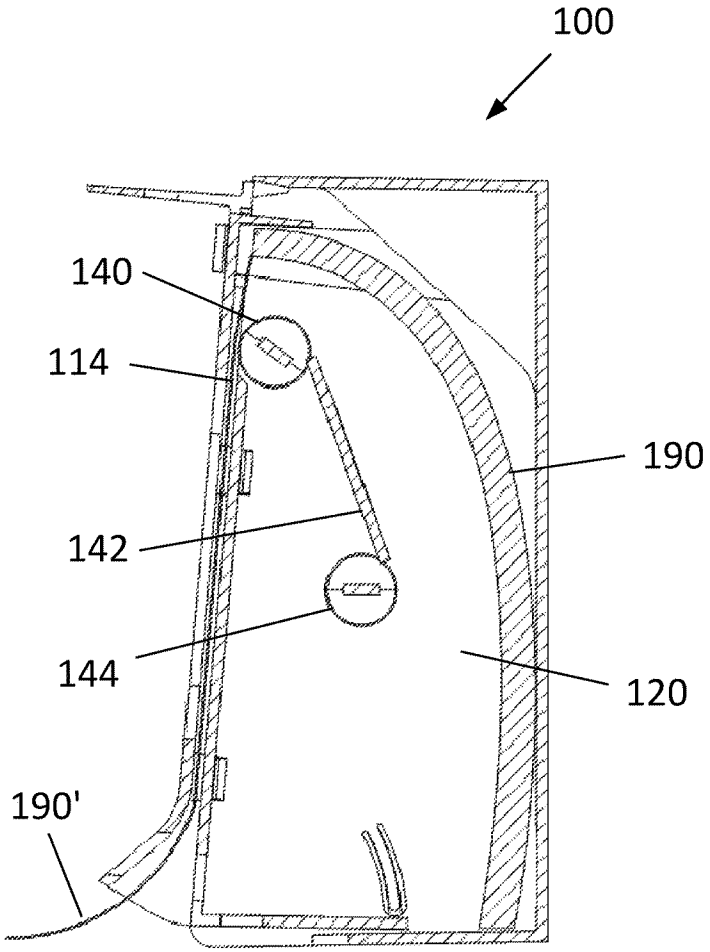
Figure 1I:
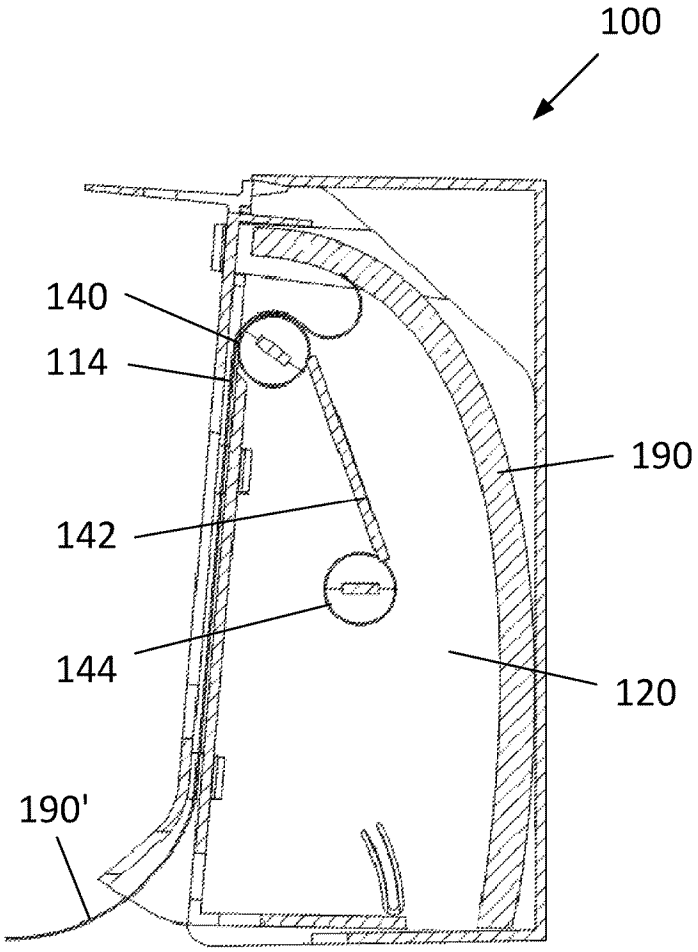

The internal face of the dispensing wall 110 (e.g. the inner surface of the door 104) is provided with an internally projecting ticket retaining ledge 130, spaced apart above (in the illustrated orientation of the ticket dispenser) the pathway inlet 114. In use, with a pleated pack of tickets 190 that is longer than the height of the storage chamber 120 (i.e. the pack is taller than the height of the chamber, when stood on end on the lower wall 129, as illustrated in FIG. 1E), the pleated pack of tickets 190 is loaded into the ticket dispenser 100 with one end of the pack tucked under the retaining ledge 130, and the other end of the pack received into the diagonally opposite corner of the storage chamber 120, resting on the bottom wall (floor) 129 of the ticket storage chamber 120. The first ticket 190' is fed through the ticket pathway 112, with the free end extending out through the dispensing aperture 116, ready to be grasped by the user, as shown in FIG. 1E.

The ticket dispenser 100 may be used with tickets formed from resiliently deformable card, in which the pack of pleated tickets is sufficiently long that it is necessary for the tickets to be bowed to fit within the storage chamber 120. The interior of the ticket storage chamber 120 is configured to promote curvature in the pleated pack of tickets 190, in which the tickets are concavely curved towards the display wall 110, in the case that the pack of tickets is taller than the height of the chamber. Advantageously, concavely curving towards the display wall 100 provides increased space between the ticket pack and the display wall, adjacent the floor 129 of the storage chamber 120 (e.g. region R), in which subsequent linked tickets can curl, as the first ticket 190' is withdrawn from the dispensing aperture 116, advantageously facilitating withdrawal of the leading ticket 190' from the ticket dispenser without tickets within the ticket storage chamber jamming.

In the illustrated ticket dispenser 100, the back wall 132, which is the wall opposite to the display wall 110, is provided with mounting holes 134, by which the ticket dispenser may be connected to a wall or other suitable structure, e.g. using screws.

In the illustrated ticket dispenser 100, a roller 140 is provided close to the edge 110B' of the inner wall 110B, at the pathway inlet 114. The roller 140 serves as a guide to guide the ticket ribbon down into the ticket pathway 112 from above and provides a controlled curvature in each ticket as it flows around into the ticket pathway 112, as is illustrated in FIGS. 1E to 1J. Advantageously, by being positioned proximate the upper wall 128 of the ticket storage chamber 120, length of the ticket pathway 112 is increased, thereby increasing the proportion of the dispensed tickets 190' that is visible in the ticket pathway. Further, controlled curvature of the tickets entering the ticket pathway 112 reduces the risk of a ticket jamming, tearing or creasing within the ticket storage chamber 120 (e.g. avoiding any sudden bends that could permanently deform the ticket), as well as reducing the risk of damaging the face of the ticket (e.g. the face of a scratch-card ticket is sensitive to damage, commonly being provided with removable foil covered regions). Yet further, the roller 140 reduces the force required to withdraw a ticket from within the ticket storage chamber 120.

In the illustrated ticket dispenser 100, a baffle (wall) 142 is also provided that extends from adjacent the pathway inlet 114 (at roller 140), and the baffle extends to the central portion of the ticket storage chamber 120. In the illustrated ticket dispenser 100, a further roller 144 is provided in a central region of the ticket storage chamber 120, adjacent the opposite end of the baffle 142 from the inner wall 110B (i.e. the further roller 144 is spaced apart from the inner wall 110B).

Although in the illustrated embodiment of FIG. 1D, both are shown, one or other of the baffle 142 and further roller 144 may be omitted, with the other providing a guiding element within the central region of the ticket storage chamber.

Advantageously, the guide element provided by the baffle 142 and/or further roller 144 guide the flow of the tickets within storage chamber 120, as they are drawn from the ticket pack 190 towards the pathway inlet 114, reducing the risk of damage to the tickets approaching the pathway inlet (e.g. it can prevent the folded join between two tickets from curling under the upper roller 140).

Figure 3:
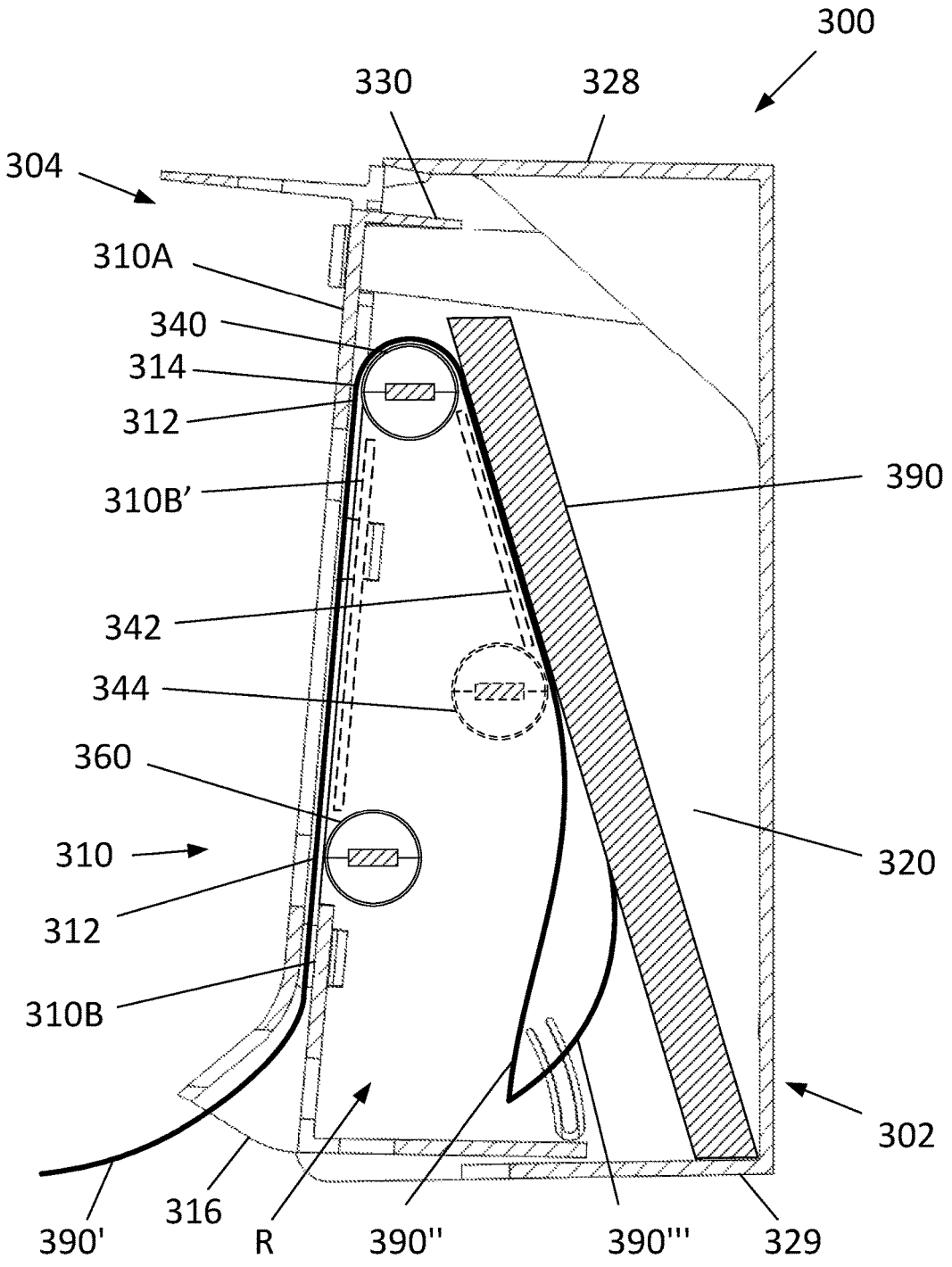
FIG. 3 shows a cut-away view of a further alternative ticket dispenser.

Further, advantageously, the guide element provided by the baffle 142 and/or further roller 144 may serve to support the ticket pack 190, which is stood on end on the lower wall 129, and so prevent the ticket pack from falling against the display wall 110, which may for example arise with tickets having a lower resilience or with a shorter ticket pack than the ticket pack 190 illustrated in FIG. 1E (for example, FIG. 3 shows a ticket dispenser 300 in use with a shorter ticket pack 390), or if the ticket is not loaded into the ticket storage chamber 120 as illustrated. In particular, the guide element spaced out in the ticket storage chamber 120, which is provided by the baffle 142 and/or further roller 144, helps to maintain a free space region R adjacent the lower wall 129 and the display wall 110 (i.e. underneath the baffle/further roller, in the orientation of the illustrated embodiments), within which the tickets 190" and 190'" can curl, as they are drawn off the pleated ticket pack 190.

Further, the baffle may inhibit the loading of tickets into the storage chamber 120 in positions that could impair dispensing performance, e.g. it may promote the loading of the ticket pack 190 into the ticket storage chamber with the end of the ticket pack that is against the lower wall 129 being spaced apart from the display wall 110. Advantageously, the baffle may promote curvature in the tickets within the ticket storage chamber 120, that may control movement of tickets through the ticket pathway in between dispensing operations, e.g. promoting shaping of the tickets that are partially unfolded, between the pathway inlet 114 and the residual main body of the ticket pack 190, which creates tension that inhibits tickets from withdrawing back into the ticket storage chamber from within the ticket pathway.

Advantageously, where both the further roller 144 and the baffle 142 are present, the further roller also guides the flow of tickets past the end of the baffle, reducing the risk of a ticket jamming, tearing or creasing within the ticket storage chamber 120, as they are drawn towards the pathway inlet 114. Additionally, the further roller 144 reduces the force required to withdraw a ticket from within the ticket storage chamber 120.

In the illustrated embodiment, the baffle 142 extends into the ticket storage chamber 120, ending to a central region of the ticket storage chamber, where the further roller 144 is also located. To maintain the free space region R, the guide element provided by the end of the baffle 142 and/or further roller 144 is preferably in the middle third of the height of the ticket storage chamber, and preferably in the middle third of the depth from the display wall 110 to the rear wall 132.

To facilitate loading a ribbon of tickets 190 into the storage chamber 120, the door 104 of the ticket dispenser 110 is pivotally connected to the box-like body 102, and opens by pivoting about the pivot points 160, as shown in FIG. 1B.

FIGS. 1E to 1J illustrate a succession of stages in the dispensing of the first ticket 190' of the ticket ribbon 190. The illustrated tickets are resiliently deformable (i.e. they return to approximately their original shape after being curved during dispensing) and formed into a ribbon of tickets 190 that are folded into a pleated pack along perforation lines (joins) between successive pleats (each pleat may comprise one or more tickets). In all of FIGS. 1E to 1J, the upper roller 140 guides the ticket ribbon 190 through the pathway inlet 114 into the ticket pathway 112. The inner wall 110B extends down to the dispensing aperture 116, and guides the ticket through the dispensing aperture. As the ticket ribbon 190 is drawn out through the dispensing aperture 116 from the ticket pathway 112, the subsequent tickets 190" and 190'" are drawn off the main ticket pack, towards and into the pathway inlet 114, causing them to curl into the free space region R and for the fold 192 between successive tickets to open. In FIGS. 1E to 1H the baffle 142 and/or lower roller 144 are shown controlling deformation of the subsequent tickets 190" and 190'" within the ticket storage chamber 120, which advantageously enhances their flow towards the pathway inlet 114.

In the ticket dispenser 100 of FIGS. 1A to 1J, the flow of tickets within the storage chamber 120 towards the ticket inlet 114 of the ticket pathway 112 is facilitated by guide elements, provided by rollers 140 and 144, in addition to baffle 142. The ticket dispenser 200 of FIG. 2 differs from the ticket dispenser 100 of FIG. 1D by the flow of the tickets into the ticket inlet 214 alternatively being guided by one or more fixed, gently curved elements 246 and 248, in addition to baffle 242. In the illustrated ticket dispenser 200, the curved elements 246 and 248 are gently curved wall portions (e.g. having a radius of curvature that is more than double the thickness of the inner wall and/or baffle), extending from the ends of the baffle 242. The fixed curved elements 246 and 248 and baffle 242 of FIG. 2 advantageously enhance the flow of tickets towards the pathway inlet 214, in a similar manner to the rollers 140 and 144 and baffle 142 illustrated in FIG. 1D. As with the embodiment of FIG. 1D, the inner wall 210B extends to the dispensing aperture 216, and guides a dispensed ticket to the dispensing aperture.

Figure 2:
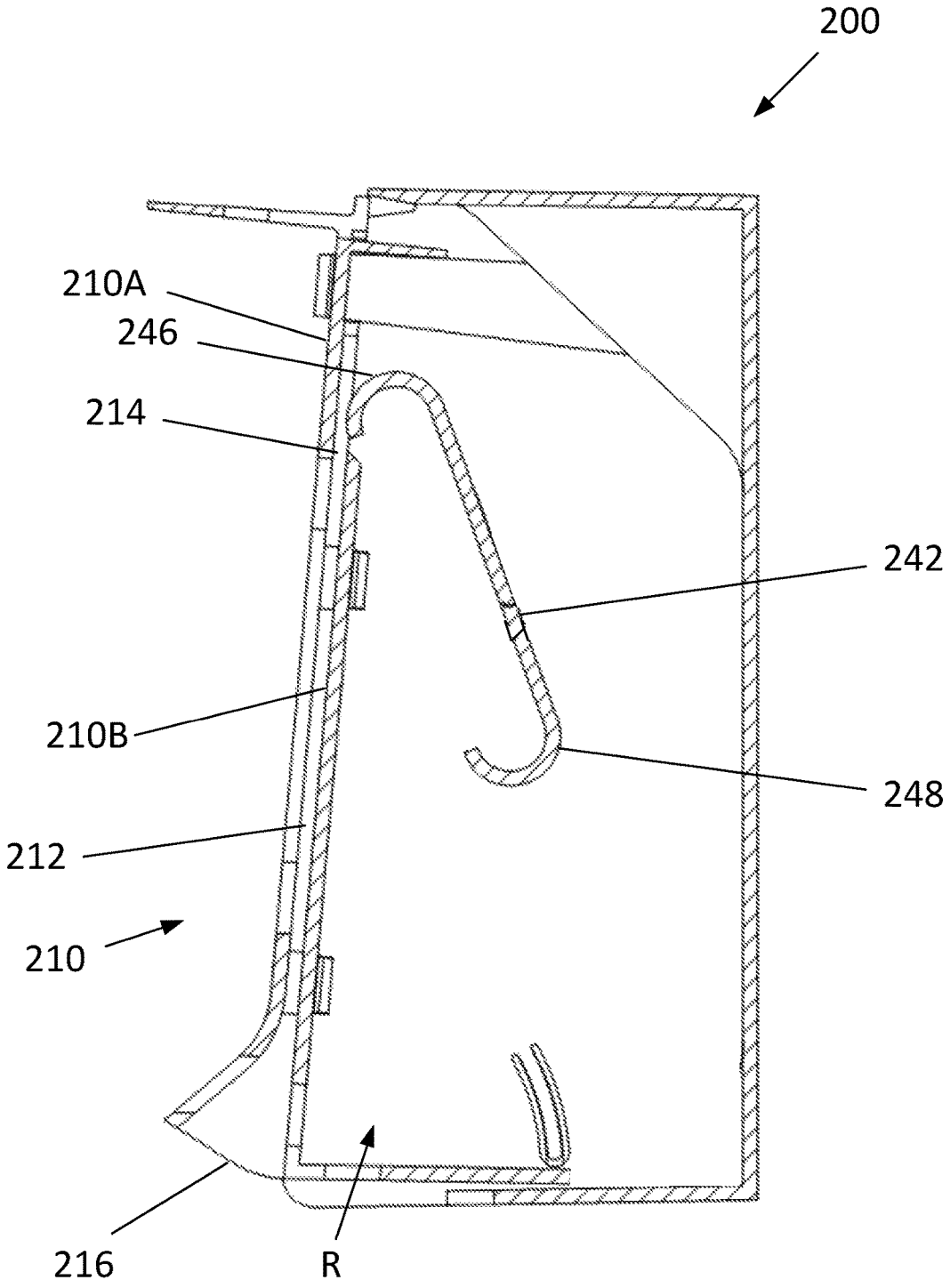
FIG. 2 shows a cut-away view of an alternative ticket dispenser.
Figure 4:
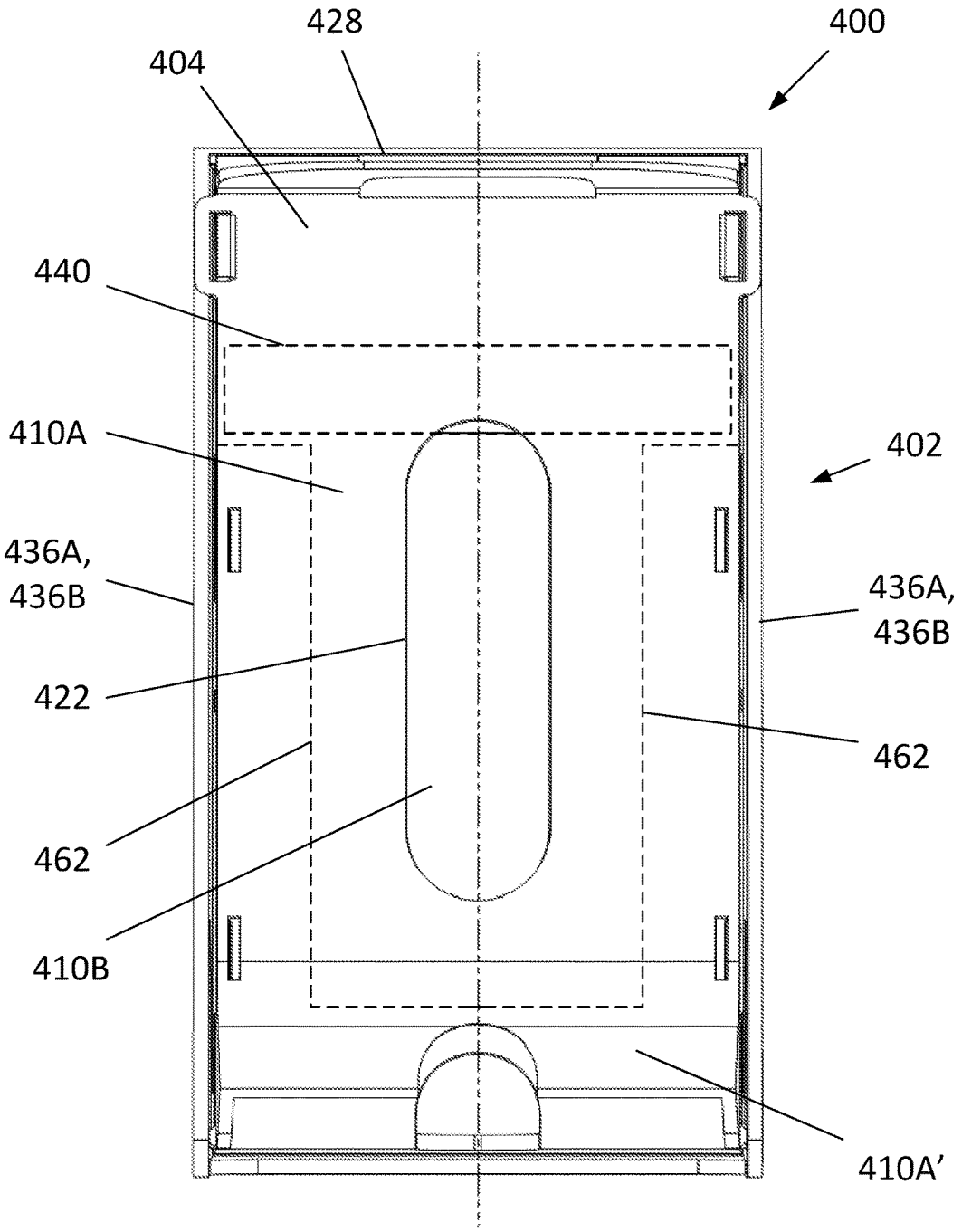
FIG. 4 shows a view directly towards the dispensing wall of a further ticket dispenser.

The ticket dispensers of FIGS. 1A to 2 are provided with a ticket pathway 212 extending along the display wall 210, within a double-walled region 210A and 210B. FIGS. 3 and 4 show alternative arrangements of a ticket pathway and ticket guiding within the ticket storage chamber 320.

In the ticket dispenser of FIG. 3, the ticket pathway 312 extends along the interior face of the outer wall 310A. The ticket dispenser 300 differs from the ticket dispenser 100 of FIG. 1D by the dispensed ticket 390' (in addition to the roller 340 at the pathway inlet 314) being guided to the dispensing aperture 316 by an additional roller 360 proximate the dispensing aperture, and by the absence of the major part of the inner wall 110B shown in FIG. 1D, apart from a portion 310B adjacent the dispensing aperture 316 (although a portion of inner wall 310B' may optionally additionally be provided, as indicated). Accordingly, the ticket pathway 312 through which tickets 390' and 390" travel, prior to exiting through the dispensing aperture 316, extends along the interior face of the outer wall 310A from the pathway inlet 314, where the tickets are guided by the inlet roller 340, and past the additional roller 360, to the dispensing aperture 316.

In the ticket dispenser 300 of FIG. 3, either the baffle 342 or the further roller 344 may be omitted, leaving only the other guide element to guide the ticket flow within the ticket storage chamber and maintain the free space region R into which the tickets 390" and 390'" curl during dispensing. The ticket dispenser 300 is shown in use with a ticket pack 390, which is shorter than that of FIG. 1D, and the guiding element within the central region of the ticket storage chamber 320 (the central end of the baffle 342 and/or the further roller 344) is shown supporting the ticket pack. As with other embodiments, it will be appreciated that the ticket dispenser may also be used with longer ticket packs.

In the embodiment of FIG. 1D, the inner wall 110B extends across the full width of the ticket storage chamber 120. In contrast, FIG. 4 shows a view of a further ticket dispenser 400, facing towards the door 404, which differs from the ticket dispenser 100 of FIG. 1D by the dispensed ticket being guided into and out of the ticket pathway by lateral guides 462 projecting in towards each other from opposite sides of the housing (e.g. projecting in from the sides 436B of the door 404, or projecting in from the sides of the box-like body 402, but not extending across the full width of the ticket dispenser in the central portion), and extending along and proximate the outer wall 410A. In the ticket dispenser 400 of FIG. 4, the provision of a guiding element within a central region of the ticket storage chamber (e.g. a baffle and/or further roller) are not shown.

Ticket dispensers according to the present invention are particularly suited for use in the orientation in which the illustrated embodiments 100, 200, 300 and 400 have been shown. Advantageously, the ticket dispensers according to the present invention enable reliable ticket dispensing from a pleated pack of tickets that is stood on end (i.e. on the folded joins between successive pleats). In particular, this arrangement enables the ticket dispensers to have a low footprint (e.g. lower than from ticket dispensers in which the ticket pack is laid down), which is advantageous in a retail setting, e.g. on a retail counter.

Ticket dispensers 100, 200, 300 and 400 have been illustrated in which the display wall and corresponding ticket pathway are provided in the opening door. However, alternatively, the display wall and corresponding ticket pathway may be provided in an alternative face of the box-like body, e.g. in the lower wall or the rear wall (opposite to the display wall).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A ticket dispenser for dispensing tickets from a pleated ribbon pack of tickets, the ticket dispenser comprising a ticket storage chamber within a housing and a ticket dispensing aperture, wherein the ticket storage chamber is provided between a ticket display wall and an opposed rear wall, and mutually opposed first and second walls that each extend between the ticket display wall and the rear wall, the ticket display wall comprising: an outer wall having an interior face, and an inner ticket pathway guide proximate the outer wall, providing a ticket display pathway extending along the interior face of the outer wall, between the outer wall and the inner ticket pathway guide, the ticket display pathway having a pathway inlet proximate the second wall, wherein all or part of the outer wall is formed from transparent material, wherein the ticket dispenser is configured for a ticket to be drawn out from a pack of tickets housed within the storage chamber, through the pathway inlet, along the ticket display pathway towards the first wall, and out through the dispensing aperture, wherein the ticket storage chamber has a chamber length extending along the display wall between the first wall and the second wall, and the ticket display pathway extends along more than half of the chamber length, wherein the ticket storage chamber is provided with a storage chamber guide at a fixed location in a central region of the storage chamber and configured to space tickets apart from the ticket display wall adjacent a central portion along the length of the ticket display pathway, and wherein the storage chamber guide extends to a maximal separation from the ticket display pathway at a location that has a smaller separation from the first wall than the separation between the pathway inlet and the first wall.

2. A ticket dispenser according to claim 1, wherein the storage chamber guide comprises a baffle extending into the ticket storage chamber from proximate the pathway inlet.

3. A ticket dispenser according to claim 1, wherein the storage chamber guide comprises a roller spaced apart from the display wall.

4. A ticket dispenser according to claim 1, wherein the storage chamber guide comprises a fixed curved member spaced apart from the display wall.

5. A ticket dispenser according to claim 1, wherein the storage chamber guide extends to at least 2 cm from the ticket display pathway.

6. A ticket dispenser according to claim 1, wherein the storage chamber guide extends to a maximal separation from the ticket display pathway that is in the middle third of the separation between the ticket display pathway and the rear wall.

7. A ticket dispenser according to claim 1, wherein the storage chamber guide extends to a maximal separation from the ticket display pathway at a location that is separated from the first wall by at least one third of the separation between the pathway inlet and the first wall and by less than two thirds of the length of the chamber.

8. A ticket dispenser according to claim 1, wherein the inner ticket pathway guide comprises lateral guides projecting towards each other from opposite sides of the housing, the lateral guides extending along and proximate to the outer wall.

9. A ticket dispenser according to claim 1, wherein the inner ticket pathway guide comprises a roller adjacent the pathway inlet.

10. A ticket dispenser according to claim 1, wherein the inner ticket pathway guide comprises a roller adjacent the dispensing aperture.

11. A ticket dispenser according to claim 1, wherein the separation between the interior face of the outer wall and the inner ticket pathway guide adjacent the ticket dispensing aperture is greater than the separation between the interior face of the outer wall and the inner ticket pathway guide adjacent the pathway inlet.

12. A ticket dispenser according to claim 1, wherein a region of the ticket display pathway adjacent the dispensing aperture has a separation between the interior face of the outer wall and the inner ticket pathway guide that increases towards the dispensing aperture.

13. A ticket dispenser according to claim 1, wherein a region of the outer wall adjacent the dispensing aperture extends outwardly away from the storage chamber.

14. A ticket dispenser according to claim 1, wherein the outer wall comprises a manipulation aperture, configured to enable a user to contact the face of a ticket within the ticket display pathway, to enable the user to draw the ticket through the ticket display pathway.

15. A ticket dispenser according to claim 14, wherein the manipulation aperture is elongate along the length of the ticket display pathway.

16. A ticket dispenser according to claim 1, wherein the inner ticket pathway guide comprises an inner wall, and the inner wall and the outer wall at least partially overlap to provide a double-walled region of the dispensing wall, in which the inner wall extends along and is proximate to the outer wall.

17. A ticket dispenser according to claim 16, wherein within the double-walled region, the inner wall and the outer wall are each substantially planar.

18. A ticket dispenser according to claim 1, wherein the dispensing aperture is provided in the display wall proximate to the first wall.

19. A ticket dispenser according to claim 18, wherein the display wall is provided with a handle projecting outwardly and proximate to an opposed end of the display wall from the dispensing aperture.

* * * * *